United States Patent [19]

Benjamin

[11] 4,239,310

[45] Dec. 16, 1980

[54] CONTAINER DOOR AND BACK THEREFOR

[75] Inventor: Delmar E. Benjamin, Monroe, Ohio

[73] Assignee: The Celotex Corporation, Tampa, Fla.

[21] Appl. No.: 26,278

[22] Filed: Apr. 2, 1979

[51] Int. Cl.[3] ..... A47B 55/00

[52] U.S. Cl. ..... 312/227; 312/214; 312/224; 312/245

[58] Field of Search ..... 312/138 R, 214, 226, 312/227, 242, 245, 257 R, 257 SR; 49/70, 394; 52/403; 270/67; 229/74

[56] References Cited

U.S. PATENT DOCUMENTS

| | | | |
|---|---|---|---|
| 1,721,953 | 7/1929 | Hendrickson | 49/70 |
| 3,109,685 | 11/1963 | Skorupa | 312/227 |
| 3,302,820 | 2/1967 | Lander | 312/214 |

*Primary Examiner*—Casmir A. Nunberg
*Attorney, Agent, or Firm*—Charles W. Vanecek; James W. Grace

[57] ABSTRACT

A door for attachment to a container, particularly a medicine cabinet, includes a frame having slotted openings and an object, especially a medicine cabinet mirror, fitted therein; and a door back mounted against the object back surface, said door back including tabs adapted to engage with said slotted openings to hold said object in place and a latch adapted to secure said door in a closed position to said container.

39 Claims, 5 Drawing Figures

FIG. 1
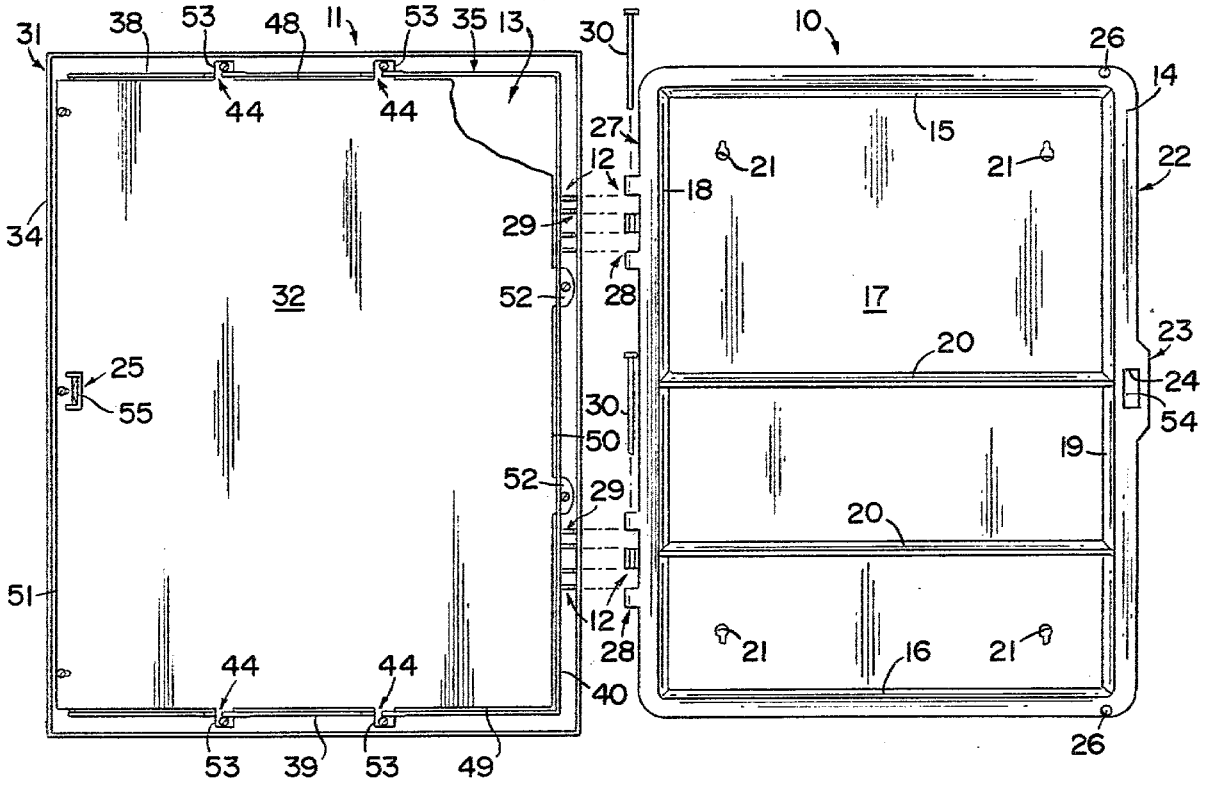
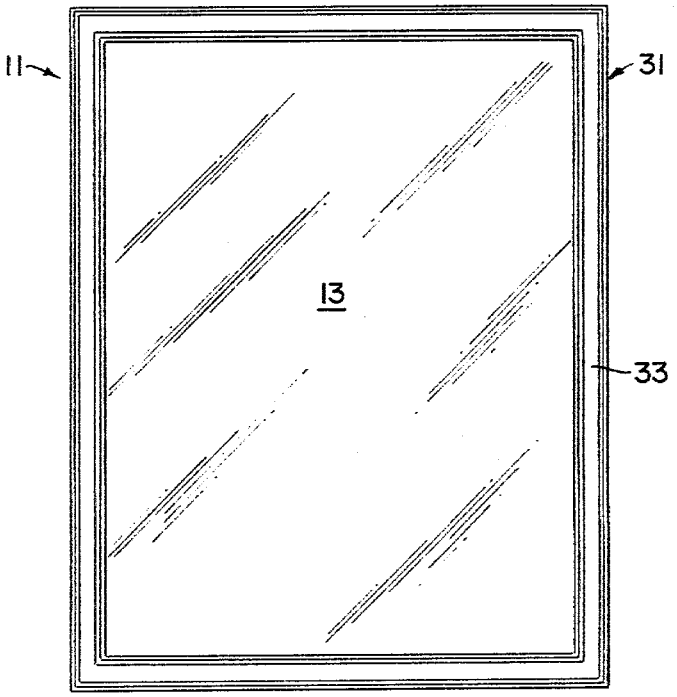
FIG. 2

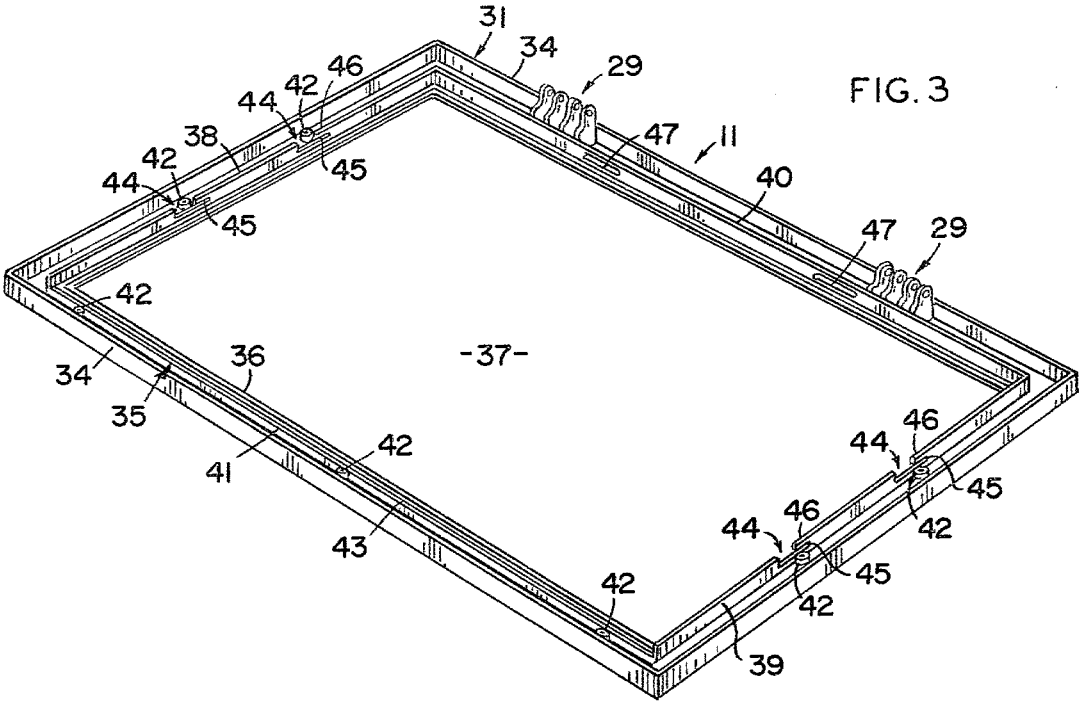
FIG. 3
FIG. 4
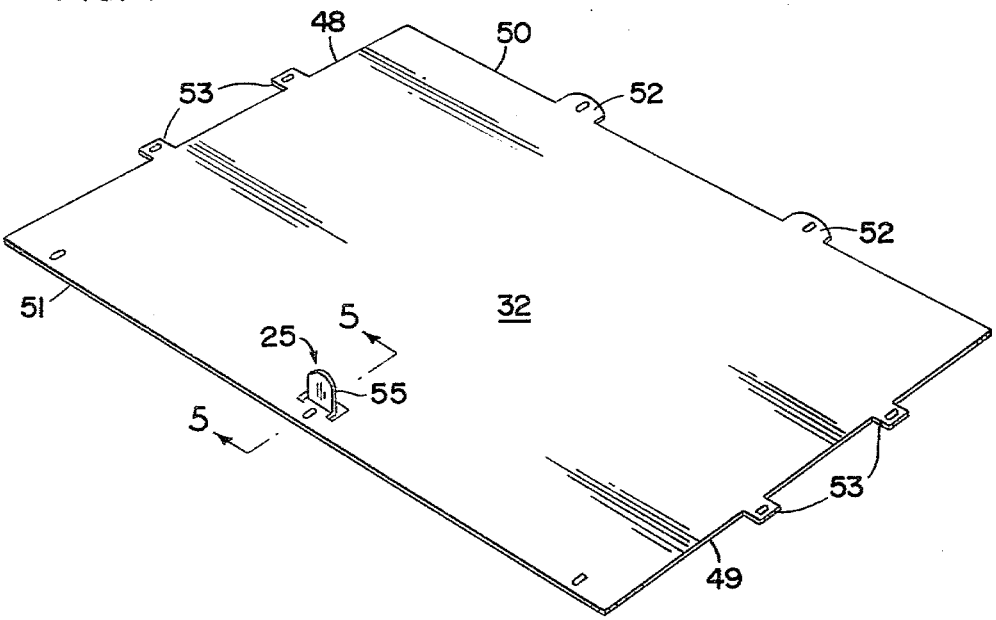
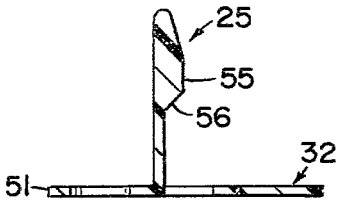
FIG. 5

CONTAINER DOOR AND BACK THEREFOR

BACKGROUND OF THE INVENTION

1. Field of the Invention

This invention relates to a container door having an object installed therein, especially a bathroom cabient with installed mirror, and a door back which supports the object in the door frame and latches onto the container body to hold the door in a closed position.

2. Description of the Prior Art

Cabinets, in general, consist of the following parts: (1) a body in which articles are stored; (2) a door for covering the opening of the cabinet body and removing from view those articles stored; (3) a hinge which attaches the door to the body and allows the door to be opened or closed; and (4) a catch to hold the door in a closed position.

Cabinet doors are of varied construction and design. Those doors for use on medicine cabinets to be installed in a bathroom generally contain a mirror for personal grooming. Mirrored doors are more complicated in construction than plain doors in that several component parts must cooperate to provide attachment, support, decor, etc. Generally, one part, called a door back, provides the capability of attachment to the hinge and body and also has a provision for the catch to provide closure. The door back is usually a flat piece of material in which holes have been punched to provide the attachments required.

Because of the nature of the bathroom cabinet it must be manufactured with a minimum number of parts and from materials that are economical and readily available. These parts must be capable of being easily formed and assembled into the final product.

OBJECTS OF THE INVENTION

It is an object of the present invention to provide an improved container door which has a simple design and can be readily mounted on the container to open from either its right or left side.

It is another object of the present invention to provide a container door frame and backing therefor between which a framed object can be simply and securely installed.

It is yet another object of the present invention to provide a container door back which is easy to install in and remove from the container door frame.

It is still another object of the present invention to provide a container door back which has a holding catch of a simple construction which can be easily engaged and disengaged with the container for closing and opening the same.

It is a further object of the present invention to provide a container door back having a holding catch for engagement with the container to close the container door, said back being readily movable in the container door frame to permit simple adjustment of the locking connection between the container and container door.

It is a still further object of the present invention to provide a relatively simply and inexpensively constructed medicine cabinet which has a mirrored cabinet door attached thereto.

These and other objects of the invention will become more apparent as the description thereof proceeds.

SUMMARY OF THE INVENTION

The above objects were achieved in the container door back of the invention which finds particular application in a bathroom cabinet door having a mirror installed therein. The container door of the invention, comprising a door frame and door back, can be used to support any object whose front surface is to be visible after the installation of said object in the container door. The container door assembly of the invention thus finds a general utility in framing pictures, other decorative articles such as matching wallpaper, etc. The container door assembly of the invention can be fashioned in various shapes, such as, e.g., oval, rectangular, octagonal, etc.

The medicine cabinet door of the invention includes a door frame, a mirror mounted in the door frame, and the door back which holds the mirror in place and has latch means for maintaining the cabinet door in closed position upon the cabinet. The cabinet door back of the invention is easy to assemble into the mirror frame and contains an integral strike which, when the cabinet door is closed, enters into a device in the cabinet body and provides a holding catch that can be easily opened. The door back is also provided with integral tabs adapted to enter into receiver openings in the door frame and to be moved sideways within these openings whereby the door back is capable of limited sidewise movement for adjustment to its final position behind the mirror in the assembled door. By this arrangement the door back tabs function as retainers holding the door back and thus the encased mirror in the door frame. Suitable fastening means can be employed to hold the door back rigidly in place, such as a screw inserted through a slotted hole in the door back and secured in the door frame. For this purpose the slotted hole is suitably located in a portion of the door back constructed to overlap the mirror and contact a cooperative portion of the door frame. Adjustment of the integral strike in relation to the cabinet body holding device is accomplished by loosening the holding screw, moving the door back to either side so as to increase or decrease the holding power and finally retightening the screw.

The invention, more particularly, resides in a door for attachment to a medicine cabinet comprising:

(a) a frame having an opening therein and a front and a rear surface, (b) a rearwardly extending border located upon said frame rear surface at a distance inward of the inner edge of said frame defining said opening therein, said frame border having spaced slots located along its rearmost edge, (c) a mirror fitted in said frame and contacting the portion of the rear surface thereof between said frame border and said frame inner edge, with said frame border spaced slots being adjacent to and to the rear of the back surface of said mirror, and (d) a door back disposed behind and contacting said mirror back surface, said door back including (i) tabs projecting from its edges, said tabs being spaced and dimensioned to fit into said frame border spaced slots and, preferably, to be movable sideways therein, and (ii) a rearward projecting door latch adapted to engage a holding means on said medicine cabinet to secure said door in a closed position, whereby said mirror is held in place by said door back and said door back is preferably capable of sidewise movement for adjustment of the holding engagement between said door latch and medicine cabinet holding means.

DESCRIPTION OF THE DRAWINGS

In the drawings:

FIG. 1 is an exploded perspective view of the cabinet and cabinet door of the invention with a part of the cabinet door back broken away to show the mirror;

FIG. 2 is a front view of the cabinet of FIG. 1 with the cabinet door closed;

FIG. 3 is a perspective view of the back of the cabinet door of FIG. 1 without the mirror or cabinet door back in place;

FIG. 4 is a perspective view of the back of the cabinet door back; and

FIG. 5 is an enlarged cross-sectional view taken on the line 5—5 of FIG. 4 showing the cabinet door latch.

DETAILED DESCRIPTION OF THE INVENTION

This invention will be described as embodied in a cabinet constructed with the arrangement of the parts as illustrated in FIGS. 1–5. In FIG. 1 there is shown a cabinet 10 and cabinet door 11. The door is hinged to the cabinet by two or more hinges 12. Installed in door 11 is a mirror 13. Cabinet 10 can be set in a wall (recessed wall cabinet) or can be mounted against the surface of a wall (surface mounted cabinet).

Cabinet 10 comprises a housing having an open front side and facing rim 14, top and bottom walls 15 and 16, rear wall 17 and side walls 18 and 19. The cabinet is suitably fabricated from a rigid plastic or other appropriate material, such as sheet metal. It preferably comprises an integrally molded piece of plastic. Advantageously, all the shelves 20 are integrally formed on and extend forwardly from the rear wall 17 and their other edges are integral with the side walls 18, 19. Alternatively, the cabinet can be constructed so that shelves 20 are securely but removably fitted in place.

Cabinet 10 is reversible and may be installed with door 11 opening from the left or right side. Two pairs of oppositely situated key hole slots 21 are provided in rear wall 17 for securing the cabinet body to a wall by means of mounting screws.

As shown in FIG. 1, the outer edges of the bottom, top and side walls of cabinet 10 are offset to provide facing rim 14 which forms a continuous flange extending substantially parallel with the plane of rear wall 17 and rounded at its four corners. Side 22 of the facing rim has an enlarged middle portion 23 which is provided with a rectangular opening 24 for engagement with latch 25 of the door back. Two small disks 26 located on the flat facing surface of rim 14 at the corners of side 22 provide stoppers for the closed cabinet door.

The other side 27 of the facing rim is suitably adapted for hinging to the cabinet door. Various conventional hinge means can be used. In the hinge assembly shown in FIG. 1 an upper and lower set of three curved projections 28 from the outer edge of side 27 are adapted to cooperate with an upper and lower set, respectively, of projections 29 from cabinet door 11, each having four members. The various projections are located so that the upper two members of each cabinet door set fit between the upper and middle members of the corresponding cabinet set while the lower two members of the cabinet door set fit between the middle and lower members of the cabinet set. Each set of curved projections from the cabinet form three split annular collars, with the outer free ends of the upper and lower collars projecting backward and the outer free end of the middle collar of the set projecting forward. At the outer end of the cabinet door projections are provided eyes, which coincide with the vertical channel provided through the cabinet collar projections. These projections are united by means of hinge pins 30 in the final assembly.

As can be seen in FIGS. 1–4, cabinet door 11 comprises a marginal, rectangular frame-like portion 31, a door back 32 and a mirror 13 supported thereinbetween. Door frame 31 and back 32 can be formed of any suitable material but are preferably molded of a plastic material. The front surface 33 of door frame 31 is of conventional design and serves as a decorative frame for mirror 13 (See FIG. 2).

A peripherally continuous rearwardly directed rim 34 extends around the outer periphery of frame 31. Parallel to rim 34 and inward from it on frame 31 is located border 35. Border 35 comprises a rearwardly extending edge located on the rear surface of door frame 31 at a distance inward of the inner edge 36 of the frame defining rectangular opening 37 (see FIG. 3). Border 35 forms a substantially rectangularly-shaped, four-sided rim extending completely around inner edge 36 and having top and bottom sections 38 and 39 and side sections 40 and 41. Spaced alongside of all four border sections and between these sections and outer border 34 are raised, disk-like projections 42 formed with holes adapted to receive screws for secure attachment of door back 32 to the frame(See below). Nine holed projections 42 are present in the frame shown in FIGS. 1 and 3, although a greater or lesser number are possible. For example, one such projection located adjacent the midpoint of section 41 on frame 31 might be employed.

In the assembled cabinet door of the invention, vertically disposed mirror 13 is positioned against the portion of the frame rear surface between bordering rim 35 and inner edge 36 and is bordered at its edges by the rearwardly projecting rim, with the lower edge of the mirror resting on the lower horizontal section of the rim. The front surface border of the seated mirror contacts a slightly raised portion 43 of the frame rear surface immediately adjacent its inner edge 36.

Border 35 of the door frame is so constructed that at least a part of it having at least one receiver slot projects backward beyond the back surface of the installed mirror in the assembled cabinet door of the invention. Through this construction it becomes possible to retain the mirror in the door frame by means of a backing member which has a tab(s) projecting therefrom for engagement with the receiver slot(s) of the frame border. As shown in FIG. 1, top and bottom sections 38 and 39 and side section 40 of frame border 35 project backward beyond the rear surface of mirror 13 in assembled cabinet door 11. Each of these border sections has two spaced slots located along its rearmost edge and accessible for engagement with cooperating tabs of door back 32. Each of slots 44 in border top and bottom sections 38 and 39 comprises a cutout which extends into the rim and terminates in a narrow channel 45 within the rim section projecting laterally a short distance toward side section 40 of the frame. Each channel 45 is bordered by a narrow lip 46 along the rear edge of the rim (See FIG. 3). Two narrow slits 47 are formed in side section 40 of the border. The rear edge of side section 41 of the frame border does not extend backward appreciably beyond the rear surface of the mirror in the assembled cabinet door. Its backward extension is conveniently about the same as that of the rear surface of the installed mirror.

Door back 32 of the invention can be readily installed in the cabinet door. As illustrated in FIG. 4, door back 32 comprises a rectangular panel having top and bottom edges 48 and 49 and side edges 50 and 51. Door back 32 is dimensioned to fit over mirror 13 within the space bounded by side section 40 and top and bottom sections 38 and 39 of door frame 31. Advantageously, the width of door back 32 is such that side edge 51 thereof extends beyond door frame side section 41 and overlaps projections 42 adjacent this side section. Door back edges 48, 49, and 50 each have two tab-like projections spaced and dimensioned to be engageable with the complementary slots located in frame border sections 38, 39, and 40, respectively. In the assembled cabinet door these tabs extend through the frame border slots and their outer free ends terminate in the space between outer border 34 and inner border 35. The outer edges of tabs 52, which project from side edge 50, are conveniently rounded for easy insertion into slots 47 of the frame border. Tabs 53 projecting from top and bottom edges 48 and 49 of the door back are sized so as to be insertable in the corresponding slotted openings in frame border sections 38 and 39 and to be movable sideways in channels 45 within these sections. Three slotted openings are provided along edge 51 of door back 32, as shown in FIG. 4. Also, each door back projecting tab has a slotted opening therein. These slotted openings are located so as to align with the cooperating holes in projections 42 of frame 31 in the assembled cabinet door. The diameter of each of the latter holes is suitably less than the horizontal width of the corresponding slotted opening of door back 32. It thus becomes possible, after door back 32 is mounted in the cabinet door with its tabs inserted in the corresponding frame slots, to move the door back somewhat to either side without disrupting the alignment of its slotted openings and frame holes. This arrangement is useful when it becomes necessary to adjust the engagement of cabinet door latch 25 with the cabinet body, as will be explained below. The door back is firmly secured against the mirror in the door frame by means of screws fastened through the aligned slotted opening(s) and frame hole(s). Lips 46 of the door frame project over tabs 53 of the secured door back.

Adjacent the midpoint of edge 51 of the door back is formed door latch 25. Latch 25 projects rearwardly from the rear surface of the door back and is adapted for insertion in opening 24 of cabinet facing rim 14 and locking engagement with the rim. Latch 25 is advantageously integral with door back 32 and capable of limited sidewise flexing. As shown in FIGS. 1, 4, and 5, the outer free end of vertical latch 25 is curved and tapered for easy entry into opening 24. Latch 25 is positioned on the door back so that it slips past the inner vertical edge 54 of opening 24 when cabinet door 11 is moved into the closed position against facing rim 14 of the cabinet. The latch surface which is thereby brought to face side wall 19 of the cabinet is provided with an embossment 55 adjacent its rear outer end. The inner vertical edge 56 of embossment 55 extends outwardly at an angle from the flat, rearwardly projecting surface of latch 25. With cabinet door 11 in the closed position, the angled edge 56 of embossment 55 projects just behind edge 54 of facing rim opening 24 and latch embossment 55 thus serves as a catch holding cabinet door 11 in its closed position. Cabinet door 11 can be easily opened by pulling its unhinged side forward and away from the cabinet body, while at the same time slipping latch 25 past cabinet rim edge 54 and outward through opening 24. A slight pressure directed laterally outward can be applied to the rear free end of latch 25 in moving it past edge 54. The angled configuration of embossment edge 56 facilitates the disengagement of latch 25 and facing rim 14.

It should be noted that the locking means for keeping the cabinet door in the closed position can be designed otherwise than described above and still fall within the scope of the present invention. For example, door latch 25 can be designed so that embossment edge 56 extends substantially perpendicularly outward from the flat, rearwardly projecting surface of the latch. Furthermore, the door of the invention could be locked by means of a latch which is magnetically held by a receiving device in the cabinet body.

Cabinet door 11 is easily assembled. Mirror 13 is first placed in door frame 31 and then door back 32 is installed by inserting its integral tabs in the corresponding receiver openings in the door frame. With its tabs thus inserted, the door back is slid toward the hinged side of the door frame to bring its slotted openings into alignment with holed projections 42 of the door frame. Screws are then fastened through the aligned openings to firmly attach the door back to the door frame.

After the cabinet of the invention is appropriately mounted against a wall surface and the cabinet door is attached thereto, the cabinet door latch can be adjusted for more or less engagement with the cabinet facing rim as follows: All screws around door back 32 are loosened approximately one turn. Door back 32 is slid back toward the hinge for more engagement, and away from the hinge for less. All screws are then retightened while the cabinet door is held square.

Whereas the present invention has been described with respect to specific embodiments thereof, it should be understood that the invention is not limited thereto as many modifications thereof may be made. It is therefore contemplated to cover by the present application any and all such modifications as fall within the true spirit and scope of the appended claims.

I claim:

1. A door for attachment to a container comprising:

(a) a frame having an opening therein and a front and a rear surface, (b) a rearwardly extending border located upon said frame rear surface at a distance inward of the inner edge of said frame defining said opening therein, said frame border having at least one slot located along its rearmost edge, (c) an object fitted in said frame and contacting the portion of the rear surface thereof between said frame border and said frame inner edge, with said at least one frame border slot being adjacent to and to the rear of the back surface of said object, and (d) a door back disposed behind and contacting said object back surface, said door back having at least one tab projecting from an edge thereof, said at least one tab being dimensioned to fit into said at least one frame border slot, whereby said object is held in place in said frame.

2. The door of claim 1 wherein a portion of the door back overlaps the framed object and is fastened to the door frame.

3. The door of claim 1 wherein the door back includes a rearwardly extending door latch adapted to engage a holding means on the container to secure said door in a closed position.

4. The door of claim 3 wherein the at least one door back tab is adapted to be movable sideways within the at least one frame border slot, whereby the door back is capable of sideways movement for adjustment of the holding engagement between the door latch and container holding means.

5. The door of claim 4 wherein a portion of the door back overlaps the framed object, and is fastened to the door frame.

6. The door of claim 5 wherein the container is a bathroom cabinet and the object is a mirror.

7. The door of claim 6 wherein the door frame and its border and the door back and its latch are molded of a plastic material.

8. The door of claim 1 wherein:

(a) the frame is rectangular and has a rectangular opening therein, (b) the border comprises a rearwardly extending substantially rectangularly-shaped, four-sided rim located upon the frame rear surface at a distance inward of the inner edge of said frame defining said opening therein, said frame border having at least one slot located along its rearmost edge, and (c) the door back comprises a rectangular panel having top and bottom edges and two side edges.

9. The door of claim 8 wherein a portion of the door back overlaps the framed object and is fastened to the door frame.

10. The door of claim 9 wherein the door back includes a rearwardly extending door latch adapted to engage a holding means on the container to secure said door in a closed position.

11. The door of claim 10 wherein the at least one door back tab is adapted to be movable sideways within the at least one frame border slot, whereby the door back is capable of sideways movement for adjustment of the holding engagement between the door latch and container holding means.

12. The door of claim 11 wherein the container is a bathroom cabinet and the object is a mirror.

13. The door of claim 12 wherein the door frame and its border and the door back and its latch are molded of a plastic material.

14. A door for attachment to a container comprising:

(a) a rectangular frame having a rectangular opening therein and a front and a rear surface, (b) a rearwardly extending, substantially rectangularly-shaped border located upon said frame rear surface at a distance inward of the inner edge of said frame defining said opening therein, said frame border having top and bottom sections and two side sections and at least one slot located along its rearmost edge, (c) an object fitted in said frame and contacting the portion of the rear surface thereof between said frame border and said frame inner edge, with said at least one frame border slot being adjacent to and to the rear of the back surface of said object, (d) a rectangular door back disposed behind and contacting said object back surface, said door back having top and bottom edges and two side edges and at least one tab projecting from one of said door back edges, said at least one tab being dimensioned to fit into said at least one frame border slot, whereby said object is held in place in said frame, and (e) means for hingedly attaching said door to said container.

15. The door of claim 14 wherein a portion of the door back overlaps the framed object and is fastened to the door frame.

16. The door of claim 15 wherein the door back includes a door latch, said door latch comprising a rearwardly extending projection adapted to engage a holding means on the container to secure said door in a closed position.

17. The door of claim 16 wherein the at least one door back tab is adapted to be movable sideways within the at least one frame border slot, whereby the door back is capable of sideways movement for adjustment of the holding engagement between the door latch and container holding means.

18. The door of claim 17 wherein (a) the door frame includes:

(i) a rearwardly directed rim extending around its outer periphery and having top and bottom sections and two side sections, the means for hingedly attaching the door to the container being positioned between one side section of said frame outer rim and the adjacent frame border side section, said adjacent frame border side section having at least one slot located along its rearmost edge, said at least one slot being adjacent to and to the rear of the object back surface, and the other frame border side section being dimensioned not to extend backward appreciably beyond said object back surface, and (ii) at least one fastening projection having a hole therein, said at least one fastening projection being positioned between the other side section of said frame outer rim and said other frame border side section;

(b) the door back includes:

(i) at least one tab projecting from one side edge thereof and dimensioned to fit into and to be movable sideways within said at least one slot of said adjacent border side section, the lateral width of said door back being such that the other door back side edge extends beyond said other frame border side section and overlaps said at least one fastening projection, and (ii) at least one slotted opening located adjacent said other door back side edge so as to align with said at least one fastening projection hole, the diameter of the latter hole(s) being less than the horizontal width of said at least one slotted opening, whereby said door back can be moved somewhat to either side without disrupting the alignment of said at least one slotted opening and said at least one fastening projection hole; and (c) said door back is secured against the framed object by a fastener inserted through said aligned at least one slotted opening and at least one fastening projection hole.

19. The door of claim 18 wherein (a) each of the frame border top and bottom sections has at least one slot located along its rearmost edge, each of said frame border top and bottom section slots being adjacent to and to the rear of the object back surface; and (b) each of the door back top and bottom edges has at least one tab projecting therefrom, each of said door back top and bottom edge tabs being dimensioned to fit into and to be movable sideways within a respective one of said frame border top and bottom section slots.

20. The door of claim 19 wherein each of the frame border top and bottom section slots comprises a cutout which extends into the frame border section and terminates in a narrow channel within said section, said channel extending laterally a short distance toward the frame outer rim side section adjacent the means for hingedly attaching said door to the container.

21. The door of claim 20 wherein (a) a fastening projection having a hole therein is located on the frame rear surface adjacent each of the frame border slots and between the frame border and the frame outer rim;

(b) each of the door back tabs has a slotted opening therein, each of said tab slotted openings being located so as to align with a respective one of said fastening projection holes, the diameter of the latter holes being less than the horizontal width of said tab slotted openings, whereby the door back can be moved somewhat to either side without disrupting the alignment of said tab slotted openings and said respective fastening projection holes; and (c) said door back is secured against the framed object by fasteners inserted through said aligned tab slotted openings and said respective fastening projection holes.

22. The door of claim 21 wherein:

(a) there are (i) two spaced slots located along the rearmost edge of each of the frame border top section, bottom section and side section adjacent the means for hingedly attaching said door to the container;

(ii) two spaced tabs projecting from each of the door back top edge, bottom edge and side edge adjacent said means for hingedly attaching said door to said container, each of said spaced tabs being dimensioned to fit into and to be movable sideways within a respective one of said spaced slots;

(iii) three spaced fastening projections, each having a hole therein and positioned between the other frame border side section and the adjacent frame outer rim side section; and (iv) three spaced slotted openings, each being located in the door back adjacent its other side edge so as to align with a respective one of said three spaced fastening projection holes, the diameter of each of the latter holes being less than the horizontal width of the respective slotted opening, whereby said door back can be moved somewhat to either side without disrupting the alignment of said three spaced slotted openings and fastening projection holes; and (b) said door back is secured against the framed object by fasteners inserted through the aligned slotted openings and fastening projection holes.

23. The door of claim 22 wherein the container is a bathroom cabinet and the object is a mirror.

24. The door of claim 23 wherein the door frame and its border and the door back and its latch are molded of a plastic material.

25. A cabinet comprising:

(a) a housing with an open front side, said housing being formed with a rear wall and top, bottom, and two side walls extending forwardly from said rear wall, the two front edges of said side walls each having a flange which extends laterally outwardly from said housing and substantially parallel to the plane of said rear wall, (b) door hinging means on one of said side wall flanges;

(c) door closing means on the other of said side wall flanges; and (d) a door comprising:

(i) a frame having top, bottom, and two side portions defining an opening therein and a front and a rear surface, one of said frame side portions including means for engaging with said door hinging means to hingedly attach said door to said housing, (ii) a rearwardly extending border located upon said frame rear surface at a distance inward of the inner edge of said frame defining said opening therein, said frame border having at least one slot located along its rearmost edge, (iii) an object filled in said frame and contacting the portion of the rear surface thereof between said frame border and said frame inner edge, with said at least one frame border slot being adjacent to and to the rear of the back surface of said object, and (iv) a door back disposed behind and contacting said object back surface, said door back having at least one tab projecting from an edge thereof, said at least one tab being dimensioned to fit into said at least one frame border slot for holding said object in place in said frame, and a rearwardly extending door latch adapted and positioned for engaging with said housing closing means to secure said door in a closed position.

26. The cabinet of claim 25 wherein a portion of the door back overlaps the framed object and is fastened to the door frame.

27. The cabinet of claim 26 wherein the at least one door back tab is adapted to be movable sideways within the at least one frame border slot, whereby the door back is capable of sideways movement for adjustment of the holding engagement between the door latch and cabinet closing means.

28. The cabinet of claim 27 wherein the housing is fitted with shelves and the framed object is a mirror.

29. The cabinet of claim 28 wherein the housing and its shelves, the door frame and its border, and the door back and its latch are all molded of a plastic material.

30. The cabinet of claim 27 comprising:

(a) a housing with an open front side, said housing being formed with a rear wall and top, bottom, and two side walls extending forwardly from said rear wall, the two front edges of said side walls each having a flange which extends laterally outwardly from said housing and substantially parallel to the plane of said rear wall, (b) door hinging means on one of said side wall flanges;

(c) the other of said side wall flanges having an enlarged middle portion which is provided with a rectangular opening; and (d) a door comprising:

(i) a rectangular frame having top, bottom, and two side portions defining a rectangular opening therein and a front and a rear surface, one of said frame side portions including means for engaging with said door hinging means to hingedly attach said door to said housing;

(ii) a rearwardly extending, substantially rectangularly-shaped border located upon said frame rear surface at a distance inward of the inner edge of said frame defining said opening therein, said frame border having top and bottom sections and two side sections and at least one slot located along its rearmost edge, (iii) an object fitted in said frame and contacting the portion of the rear surface thereof between said frame border and said frame inner edge, with said at least one frame border slot being adjacent to and to the rear of the back surface of said object, and (iv) a rectangular door back disposed behind and contacting said object back surface, said door back having top and bottom edges and two side edges and at least one tab projecting from one of said door back edges, said at least one tab being dimensioned to fit into said at least one frame border slot for holding said object in place in said frame, and a rearwardly extending door latch adapted and positioned for insertion into and engagement with said flange rectangular opening to secure said door in a closed position.

31. The cabinet of claim 30 wherein (a) the door frame includes:

(i) a rearwardly directed rim extending around its outer periphery and having top and bottom sections and two side sections, the means for engaging with the door hinging means being positioned between one side section of said frame outer rim and the adjacent frame border side section, said adjacent frame border side section having at least one slot located along its rearmost edge, said at least one slot being adjacent to and to the rear of the object back surface, and the other frame border side section being dimensioned not to extend backward appreciably beyond said object back surface, and (ii) at least one fastening projection having a hole therein, said at least one fastening projection being positioned between the other side section of said frame outer rim and said other frame border side section;

(b) the door back includes:

(i) at least one tab projecting from one side edge thereof and dimensioned to fit into and to be movable sideways within said at least one slot of said adjacent border side section, the lateral width of said door back being such that the other door back side edge extends beyond said other frame border side section and overlaps said at lest one fastening projection, and (ii) at least one slotted opening located adjacent said other door back side edge so as to align with said at least one fastening projection hole, the diameter of the latter hole(s) being less than the horizontal width of said at least one slotted opening, whereby said door back can be moved somewhat to either side without disrupting the alignment of said at least one slotted opening and said at least one fastening projection hole;

(c) the door latch comprises a rearwardly extending projection capable of limited sidewise flexing, said projection being located adjacent the midpoint of the overlapping door back side edge with its outer free end being curved and tapered for easy entry into the housing flange rectangulr opening and the door latch side surface which faces the adjacent housing side wall in the closed position having an embossment adjacent its rear outer end, said door latch projection being positioned on said door back so that in said closed position said embossment is located just behind a portion of the housing flange rear surface lying between the vertical edge of said rectangular opening adjacent the housing side wall and said housing side wall; and (d) said door back is secured against the framed object by a fastener inserted through said aligned at least one slotted opening and at least one fastening projection hole.

32. The cabinet of claim 31 wherein (a) each of the frame border top and bottom sections has at least one slot located along its rearmost edge, each of said frame border top and bottom section slots being adjacent to and to the rear of the object back surface; and (b) each of the door back top and bottom edges has at least one tab projecting therefrom, each of said door back top and bottom edge tabs being dimensioned to fit into and to be movable sideways within a respective one of said frame border top and bottom section slots.

33. The cabinet of claim 32 wherein each of the frame border top and bottom section slots comprises a cutout which extends into the frame border section and terminates in a narrow channel within said section, said channel extending laterally a short distance toward the frame outer rim side section adjacent the means for engaging with the housing hinging means.

34. The cabinet of claim 33 wherein (a) a fastening projection having a hole therein is located on the frame rear surface adjacent each of the frame border slots and between the frame border and the frame outer rim;

(b) each of the door back tabs has a slotted opening therein, each of said tab slotted openings being located so as to align with a respective one of said fastening projection holes, the diameter of the latter holes being less than the horizontal width of said tab slotted openings, whereby the door back can be moved somewhat to either side without disrupting the alignment of said tab slotted openings and said respective fastening projection holes; and (c) said door back is secured against the framed object by fasteners inserted through said aligned tab slotted openings and said respective fastening projection holes.

35. The cabinet of claim 34 wherein (a) there are (i) two spaced slots located along the rearmost edge of each of the frame border top section, bottom section and side section adjacent the means for engaging with the housing hinging means;

(ii) two spaced tabs projecting from each of the door back top edge, bottom edge, and side edge adjacent said means for engaging with the housing hinging means, each of said spaced tabs being dimensioned to fit into and to be movable sideways within a respective one of said spaced slots;

(iii) three spaced fastening projections each having a hole therein and positioned between the other frame border side section and the adjacent frame outer rim side section; and (iv) three spaced slotted openings, each being located in the door back adjacent its other side edge so as to align with a respective one of said three spaced fastening projection holes, the diameter of each of the latter holes being less than the horizontal width of the respective slotted opening, whereby said door back can be moved somewhat to either side without disrupting the alignment of said three spaced slotted openings and fastening projection holes; and (b) said door back is secured against the framed object by fasteners inserted through the aligned slotted openings and fastening projection holes.

36. The cabinet of claim 35 wherein the housing is fitted with shelves and the framed object is a mirror.

37. The cabinet of claim 36 wherein the housing and its shelves, the door frame and its border, and the door back and its latch are all molded of a plastic material.

38. The cabinet of claim 37 wherein the inner vertical edge of the door latch embossment extends outwardly at an angle from the rearwardly projecting surface of the door latch.

39. The cabinet of claim 38 wherein the outer edges of the bottom, top and side walls of the housing are offset to provide a continuous flange extending substantially parallel with the plane of the housing rear wall and two pairs of oppositely situated key hole slots are provided in said rear wall for mounting said cabinet on a wall by means of fasteners, whereby said cabinet can be mounted with the cabinet door opening from the left or right side.

* * * * *